US011946239B2

(12) United States Patent
Tone et al.

(10) Patent No.: US 11,946,239 B2
(45) Date of Patent: Apr. 2, 2024

(54) FLUSH TOILET

(71) Applicant: TOTO LTD., Kitakyushu (JP)

(72) Inventors: Yusuke Tone, Fukuoka (JP); Masaaki Momoe, Fukuoka (JP); Eiji Shiohara, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/890,297

(22) Filed: Aug. 18, 2022

(65) Prior Publication Data

US 2023/0061790 A1 Mar. 2, 2023

(30) Foreign Application Priority Data

Aug. 27, 2021 (JP) ..... 2021-139264

(51) Int. Cl.
*E03D 11/02* (2006.01)

(52) U.S. Cl.
CPC ..... *E03D 11/02* (2013.01)

(58) Field of Classification Search
CPC ..... E03D 11/02; E03D 11/13
USPC ..... 4/252.1, 643
See application file for complete search history.

(56) References Cited

U.S. PATENT DOCUMENTS 2,508,305 A * 5/1950 Teetor ..... E05C 19/16 206/818
2,693,382 A * 11/1954 Teetor ..... E05C 19/16 292/251.5
5,190,325 A * 3/1993 Doss-Desouza ..... E05C 19/16 292/DIG. 60
2022/0316198 A1* 10/2022 Shiohara ..... E03D 11/13
2022/0316199 A1* 10/2022 Shiohara ..... E03D 11/13

FOREIGN PATENT DOCUMENTS

CN 206015830 U * 3/2017
GB 2254644 A * 10/1992 ..... E05C 19/16
JP 2020-165173 10/2020
KR 20140067779 A * 6/2014

* cited by examiner

*Primary Examiner* — Lori L Baker
(74) *Attorney, Agent, or Firm* — Amin, Turocy & Watson, LLP

(57) ABSTRACT

A flush toilet includes: a toilet body; a function unit arranged in a rear part of the toilet body; a panel member covering a side surface of the function unit and including a protruding part protruding toward the toilet body; and a holding part causing the toilet body and the panel member to hold to each other by magnetic force. The toilet body includes: a reception part arranged under the protruding part and receiving the protruding part in a state where the panel member is attached to the toilet body; and a protrusion part extending upward from the reception part. When the panel member is attached to the toilet body, the protrusion part is in a position where at least a part of the protrusion part is overlapped with the protruding part in a rear view when the toilet body is viewed from behind.

7 Claims, 7 Drawing Sheets

FLUSH TOILET

CROSS-REFERENCE TO RELATED APPLICATION

The present application claims priority to and incorporates by reference the entire contents of Japanese Patent Application No. 2021-139264 filed in Japan on Aug. 27, 2021.

FIELD

An embodiment of the disclosure relates to a flush toilet.

BACKGROUND

Conventionally, in a flush toilet whose function unit is covered by a panel member, there has been known a technology that employs magnetic force in order to attach and hold the panel member to a toilet body (see Japanese Laid-open Patent Publication No. 2020-165173, for example).

Incidentally, for example, in a case where a panel member is wiped down in cleaning a flush toilet, load in the front-back direction or the like is applied to the panel member in some cases. However, in the conventional technology, for example, when the above-mentioned load exceeds magnetic force holding the panel member, there presents possibility that the panel member falls off from a toilet body, and thus there presents a room for improvement therein.

SUMMARY

A flush toilet according to one aspect of an embodiment includes: a toilet body; a function unit that is arranged in a rear part of the toilet body; a panel member that covers a side surface of the function unit; and a holding part that causes the toilet body and the panel member to attract and hold to each other by using magnetic force, wherein the panel member includes a protruding part that is formed to protrude toward the toilet body, the toilet body includes: a reception part that is arranged under the protruding part, and receives the protruding part in a state where the panel member is attached to the toilet body; and a protrusion part that is formed to extend upward from the reception part, and in a state where the panel member is attached to the toilet body, the protrusion part is formed in a position where at least a part of the protrusion part is overlapped with the protruding part in a rear view when the toilet body is viewed from behind.

The above and other objects, features, advantages and technical and industrial significance of this invention will be better understood by reading the following detailed description of presently preferred embodiments of the invention, when considered in connection with the accompanying drawings.

DESCRIPTION OF EMBODIMENT

Hereinafter, details of an embodiment of a flush toilet according to the present application will be specifically explained with reference to the accompanying drawings. Note that the present disclosure is not limited to an embodiment described hereinafter. The drawings are schematic, and thus note that relation between sizes of elements, a ratio between the elements, and the like may be different from those in reality. Between the drawings, there may be also present a case where a part is included whose relation or ratio between the sizes are different from each other.

Embodiment

Figure 1:
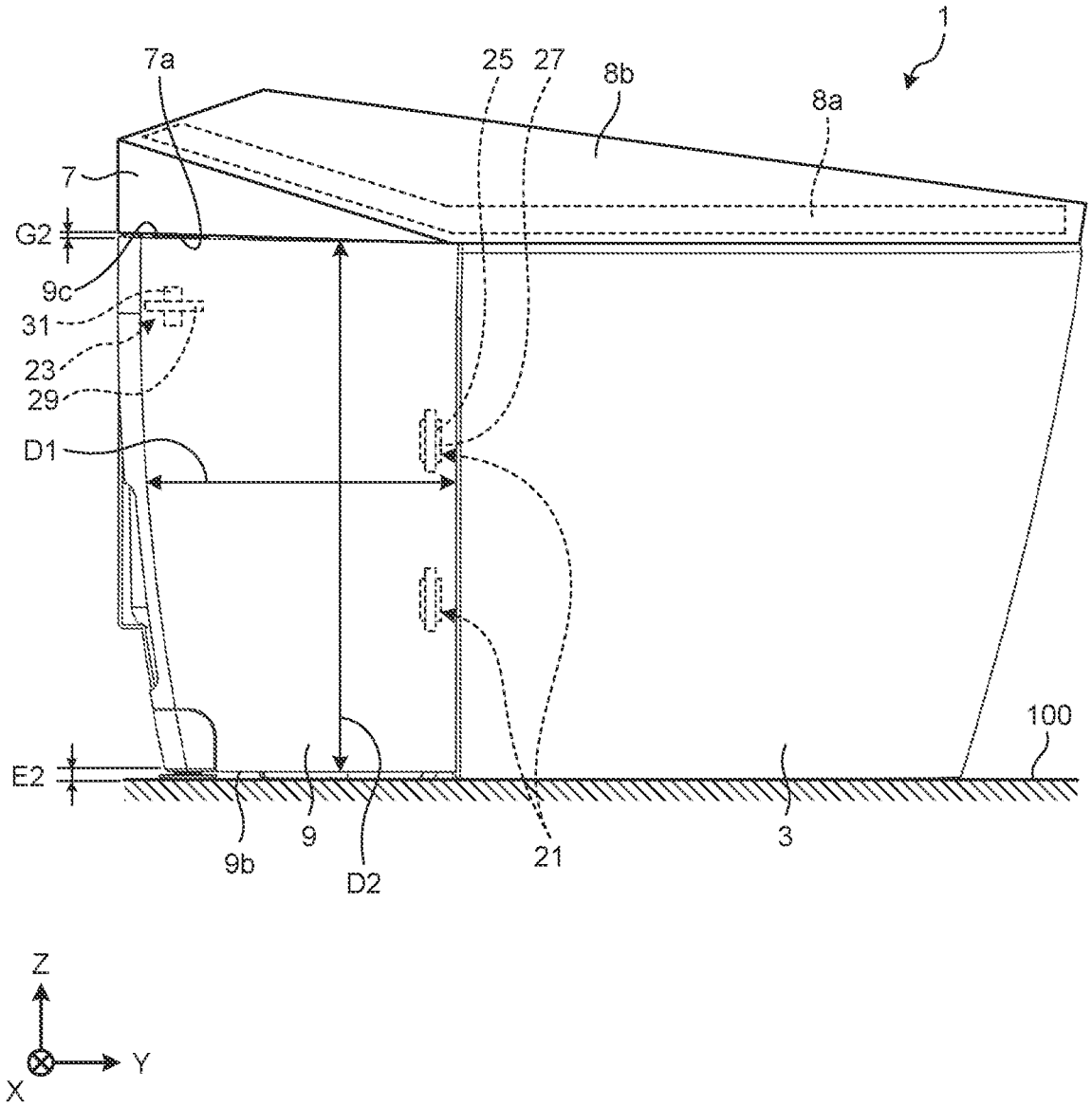
FIG. 1 is a side view illustrating a flush toilet according to an embodiment.
Figure 2:
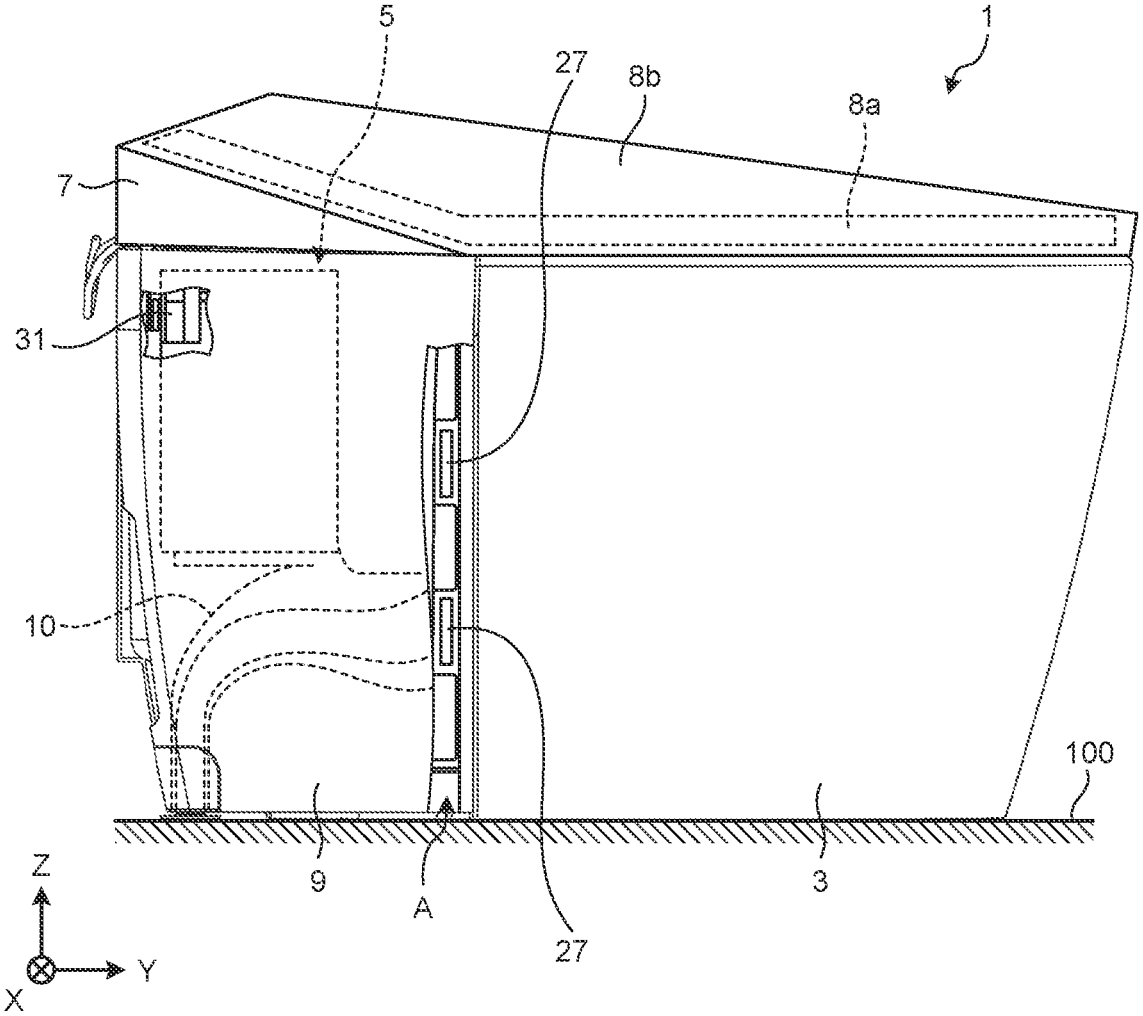
FIG. 2 is a side view illustrating the flush toilet from which a part of a panel member is omitted.

An overall configuration of a flush toilet 1 according to an embodiment will be explained with reference to FIGS. 1 and 2. FIG. 1 is a side view illustrating the flush toilet 1 according to the embodiment. FIG. 2 is a side view illustrating the flush toilet 1 from which a part of a panel member 9 is omitted.

In FIGS. 1 and 2, for convenience of explanation, a three-dimensional orthogonal coordinate system including a Z-axis whose positive direction is the vertical direction (upward) is illustrated. The above-mentioned orthogonal coordinate system may be illustrated in other drawings. In the above-mentioned orthogonal coordinate system, the positive direction of a Y-axis is prescribed as a front direction, the negative direction of the Y-axis is prescribed as a reverse direction, the positive direction of an X-axis is prescribed as a left direction, and the negative direction of the X-axis is prescribed as a right direction. Thus, in the following explanation, an X-axis direction may be referred to as a left-right direction, a Y-axis direction may be referred to as a front-back direction, and a Z-axis direction may be referred to as an up-and-down direction.

The flush toilet 1 according to the embodiment is a flush toilet that is arranged on a floor surface 100, which is a so-called floor-placed flush toilet. Note that the flush toilet 1 may be a so-called wall-mounted flush toilet that is mounted on a not-illustrated wall surface.

As illustrated in FIGS. 1 and 2, the flush toilet 1 includes a toilet body 3, a function unit 5, a sanitary washing device 7, and the panel member 9. The toilet body 3 is made of pottery, for example. Note that the toilet body 3 is not limitedly made of pottery, and may be made of resin or may be made of combination of pottery and resin, for example.

The toilet body 3 includes a bowl part 4 (see FIG. 4 to be mentioned later) and a drainage water trap pipeline 10 (see FIG. 2). The bowl part 4 is formed in bowl-shaped to be able to receive a waste. On an upper periphery of the bowl part 4, a rim part 4*a* (see FIG. 4) is formed, flush water is spouted from a rim water spout port (not illustrated) of the above-mentioned rim part 4*a* so as to wash the bowl part 4. The flush water having washed the bowl part 4 is discharged via the drainage water trap pipeline 10.

As illustrated in FIG. 2, the function unit 5 is arranged in a rear part of the toilet body 3. For example, the function unit 5 has function of supplying water to the bowl part 4 of the toilet body 3 and the sanitary washing device 7. For example, the function unit 5 includes a water storage tank (not-illustrated), a pressure pump (not illustrated), and the like so as to cause the pressure pump to pressurize flush water stored in the water storage tank, and spouts the pressurized flush water from a jet water spout port (not illustrated) to the bowl part 4 at a large flow volume.

The sanitary washing device 7 is arranged in an upper part of the toilet body 3 so as to include a toilet seat part 8*a*, a lid part 8*b* that covers the toilet seat part 8*a*, a not-illustrated nozzle device, and the like. The sanitary washing device 7 ejects washing water from the above-mentioned nozzle device toward a body of a user to be able to wash a private part thereof. In the above mentioned, the sanitary washing device 7 has a sanitary washing function; however, not limited thereto, the sanitary washing device 7 may have, for example, a drying function for blowing warm air to a bottom of a user sitting on the toilet seat part 8*a* so as to dry the bottom, a toilet-seat heating function for appropriately heating a seating surface of the toilet seat part 8*a*, and the like.

The panel member 9 is arranged in the rear part of the toilet body 3 so as to cover a side surface of the function unit 5 (see FIG. 2). By employing the panel member 9, it is possible to prevent external damage and/or intrusion of sewage to the function unit 5. Note that the panel member 9 is made of resin, for example; however, not limited thereto.

The panel member 9 is attached and held to the toilet body 3 by using magnetic force. In a case where being attached to the toilet body 3 and being positioned with respect to the toilet body 3 (positional adjustment is executed), the panel member 9 according to the present embodiment is configured such that the panel member 9 is capable of sliding with respect to the toilet body 3 and/or the function unit 5 in the front-back direction indicated by using an arrow D1 and the up-and-down direction indicated by using an arrow D2 that are illustrated in FIG. 1, for example; this point will be mentioned later.

Next, details of a configuration related to attachment between the panel member 9 and the toilet body 3 will be explained.

The flush toilet 1 includes first holding parts 21 and a second holding part 23. The toilet body 3 and a side surface of the panel member 9 are attracted and held by the first and second holding parts 21 and 23 by using magnetic force. Specifically, a side surface of the toilet body 3 and a side surface of the panel member 9 are attracted and held by the first holding parts 21 by using magnetic force. A side surface of the function unit 5 arranged in the rear part of the toilet body 3 and a side surface of the panel member 9 are attracted and held by the second holding part 23 by using magnetic force.

The first holding parts 21 will be explained, the first holding parts 21 are arranged in a boundary portion A (see FIG. 2) between the toilet body 3 and the panel member 9. The boundary portion A is a part in which the toilet body 3 and the panel member 9 are overlapped with each other when the panel member 9 is appropriately arranged on the toilet body 3.

Figure 3:
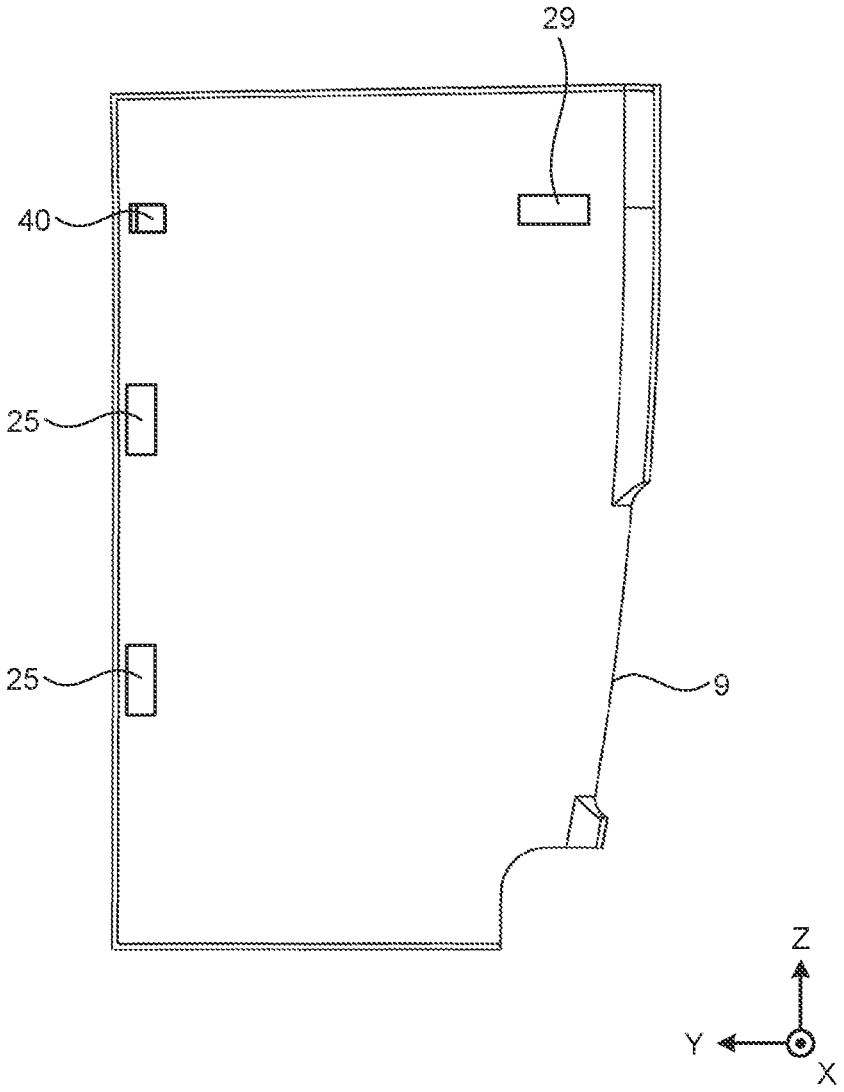
FIG. 3 is a side view illustrating the panel member according to the embodiment viewed from the inside.

Herein, the first holding parts 21 will be explained additionally with reference to FIG. 3. FIG. 3 is a side view illustrating the panel member 9 according to the embodiment viewed from the inside.

As illustrated in FIGS. 1 to 3, each of the first holding parts 21 includes a panel-side magnetic material 25 and a body-side magnetic material 27. The panel-side magnetic material 25 is a magnetic material provided in the panel member 9, and is a magnet, for example. Hereinafter, the panel-side magnetic material 25 may be referred to as "magnet 25". The body-side magnetic material 27 is a magnetic material provided in the toilet body 3, and is a metallic sheet material, in other words, a sheet metal, for example. Hereinafter, the body-side magnetic material 27 may be referred to as "sheet metal 27".

In the above mentioned, an example is indicated in which the panel-side magnetic material 25 is a magnet, and the body-side magnetic material 27 is a sheet metal; however, not limited thereto, for example, the panel-side magnetic material 25 may be a sheet metal, and the body-side magnetic material 27 may be a magnet. Moreover, a magnet may be employed instead of the sheet metal 27.

The plurality of magnets 25 (for example, two magnets) is arranged in a front edge part on an inner surface of the panel member 9, in other words, a periphery of a boundary between the toilet body 3 and the panel member 9. The two magnets 25 are respectively arranged in an interval between an upper end and the center of the panel member 9, and in an interval between a lower end and the center of the panel member 9, for example.

Each of the magnets 25 is a rectangular parallelepiped whose thickness is small, and is bonded to the panel member 9, for example. Each of the magnets 25 is formed such that short sides thereof are along the front-back direction and long sides thereof are along the up-and-down direction; however, a shape of the magnet 25 is not limited thereto, and may be formed in an arbitrary shape.

As illustrated in FIGS. 1 and 2, the sheet metals 27 are arranged in positions in the toilet body 3 corresponding to the respective magnets 25. Each of the sheet metals 27 is a rectangular parallelepiped whose thickness is small, and is bonded to the toilet body 3, for example. Each of the sheet metals 27 is formed such that short sides thereof are along the front-back direction and long sides thereof are along the up-and-down direction; however, a shape of the sheet metal 27 is not limited thereto, and may be formed in an arbitrary shape.

The above-mentioned magnets 25 attract the sheet metals 27 by using magnetic force so that the first holding parts 21 is capable of holding the panel member 9 to the toilet body 3.

Next, the second holding part 23 will be explained. As illustrated in FIG. 1, in a case where the panel member 9 is appropriately arranged in the toilet body 3, the second holding part 23 is arranged in an upper region of the panel member 9. As illustrated in FIGS. 1 and 2, the second holding part 23 includes a magnet 29 that is a magnetic material, and a metallic sheet material that is a magnetic material, in other words a sheet metal 31.

The magnet 29 is arranged in an upper edge part of an inner surface of the panel member 9 and a rear part of the panel member 9. The magnet 29 is formed in a rectangular parallelepiped whose thickness is small, and is bonded to the panel member 9, for example. The magnet 29 is formed such that short sides thereof are along the up-and-down direction and long sides thereof are along the front-back direction; however, a shape of the magnet 29 is not limited thereto, and may be formed in an arbitrary shape.

As illustrated in FIGS. 1 and 2, the sheet metal 31 is arranged in a position in the toilet body 3 (precisely, function unit 5 arranged in rear part of toilet body 3) corresponding to the magnet 29. The sheet metal 31 is formed in a rectangular parallelepiped whose thickness is small, and is bonded to the function unit 5, for example. Note that the sheet metal 31 is formed such that short sides thereof are along the front-back direction and long sides thereof are along the up-and-down direction; however, a shape of the sheet metal 31 is not limited thereto, and may be formed in an arbitrary shape.

The above-mentioned magnet 29 attracts the sheet metal 31 by using magnetic force so that the second holding part 23 is capable of holding the panel member 9 to the toilet body 3.

Regarding the above-mentioned second holding part 23, the example is exemplified in which the magnet 29 is provided to the panel member 9 and the sheet metal 31 is provided to the toilet body 3; however, not limited thereto, a configuration may be employed in which the sheet metal is provided to the panel member 9 and the magnet is provided to the toilet body 3, for example. Moreover, a magnet may be employed instead of the sheet metal 31.

Positions where the above-mentioned first and second holding parts 21 and 23 are arranged and the number thereof are merely examples; however, not limited thereto, positions and/or the number of the first and second holding parts 21 and 23 may be arbitrarily set.

Attachment of the panel member 9 to the toilet body 3 in the flush toilet 1 configured as described above will be explained, and the panel member 9 is positioned on a side (precisely, side of function unit 5) of the toilet body 3, for example. Subsequently, the above-mentioned panel member 9 is moved toward the toilet body 3 along the left-right direction (X-axis direction), and thus the panel member 9 is attached to the toilet body 3 by magnetic force of the first and second holding parts 21 and 23.

Incidentally, as described above, in the flush toilet 1 in a state where the panel member 9 is attached to the toilet body 3 by magnetic force of the first and second holding parts 21 and 23, the panel member 9 is wiped down for cleaning in some cases, for example. In this case, a load (force) works on the panel member 9, which moves the panel member 9, particularly in wiping down, a load in the front-back direction of the panel member 9 or the like easily works. In the conventional technology, in a case where the above-mentioned load exceeds magnetic force that holds the panel member 9, there presents possibility that the panel member 9 falls off from the toilet body 3.

Thus, the flush toilet 1 according to the present embodiment is configured such that falling off of the panel member 9 attached to the toilet body 3 is prevented.

Figure 4:
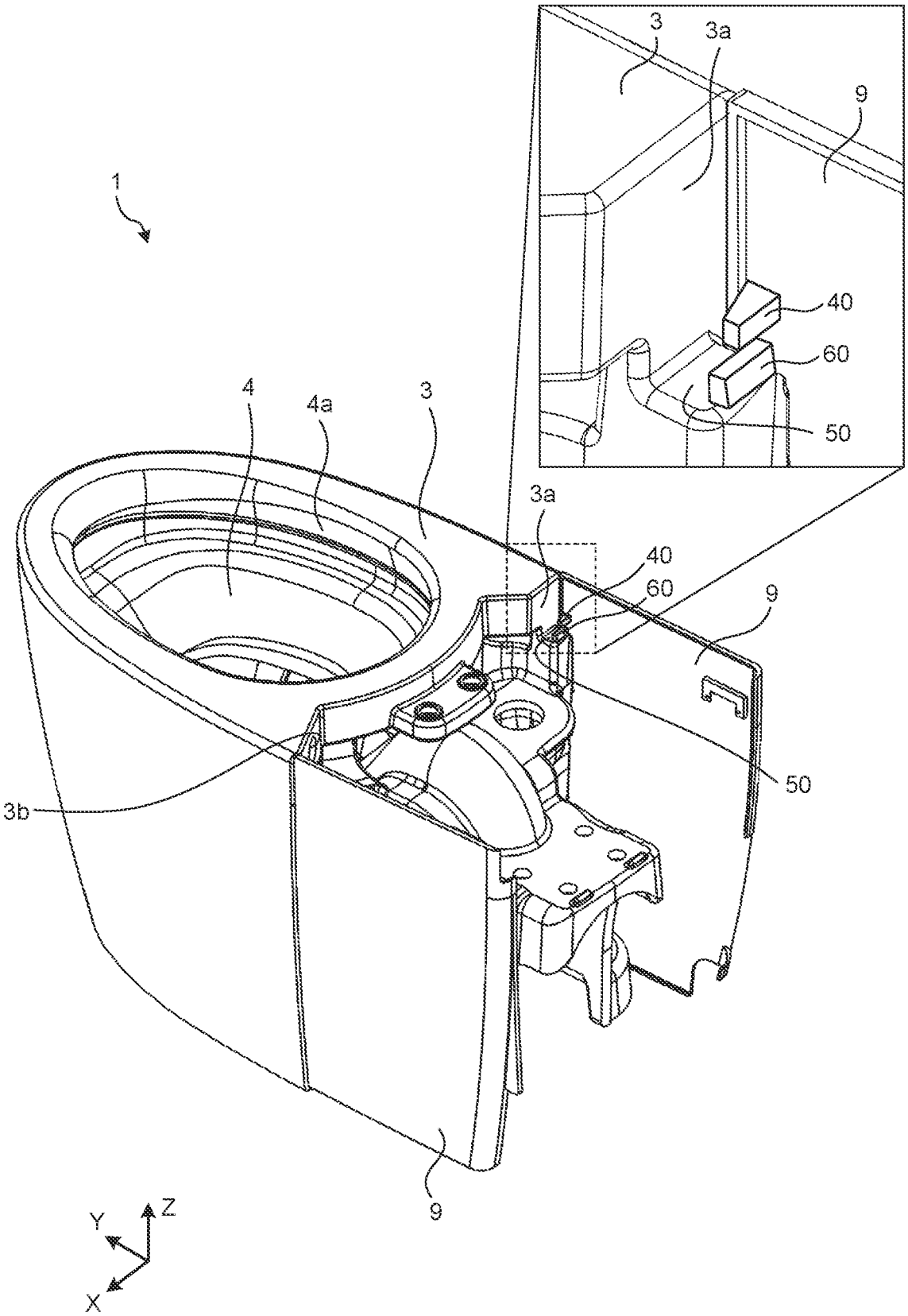
FIG. 4 is a perspective view illustrating the flush toilet viewed from the diagonally behind.

Hereinafter, the above-mentioned configuration will be specifically explained with reference to FIG. 4. FIG. 4 is a perspective view illustrating the flush toilet 1 viewed from the diagonally behind, and further is an enlarged view illustrating a part of the flush toilet 1. In FIG. 4, for convenience of comprehension, illustration of a part of the configuration such as the function unit 5 and the sanitary washing device 7 is omitted.

As illustrated in FIG. 4, the flush toilet 1 includes a protruding part 40, a reception part 50, and a protrusion part 60. The protruding part 40 is formed in the panel member 9. The reception part 50 and the protrusion part 60 are formed in the toilet body 3.

In FIG. 4, the protruding part 40, the reception part 50, and the like that are arranged on a side of a right rear portion 3*a* of the toilet body 3 are illustrated; and the protruding part 40, the reception part 50, and the like are also arranged on a side of a left rear portion 3*b* of the toilet body 3 (note that those are not shown behind panel member 9 on left side). Hereinafter, the protruding part 40 and the like arranged on a side of the right rear portion 3*a* of the toilet body 3 are exemplified, the following explanation is also similarly applied to the protruding part 40 and the like on a side of the left rear portion 3*b* of the toilet body 3 and the like.

Figure 5:
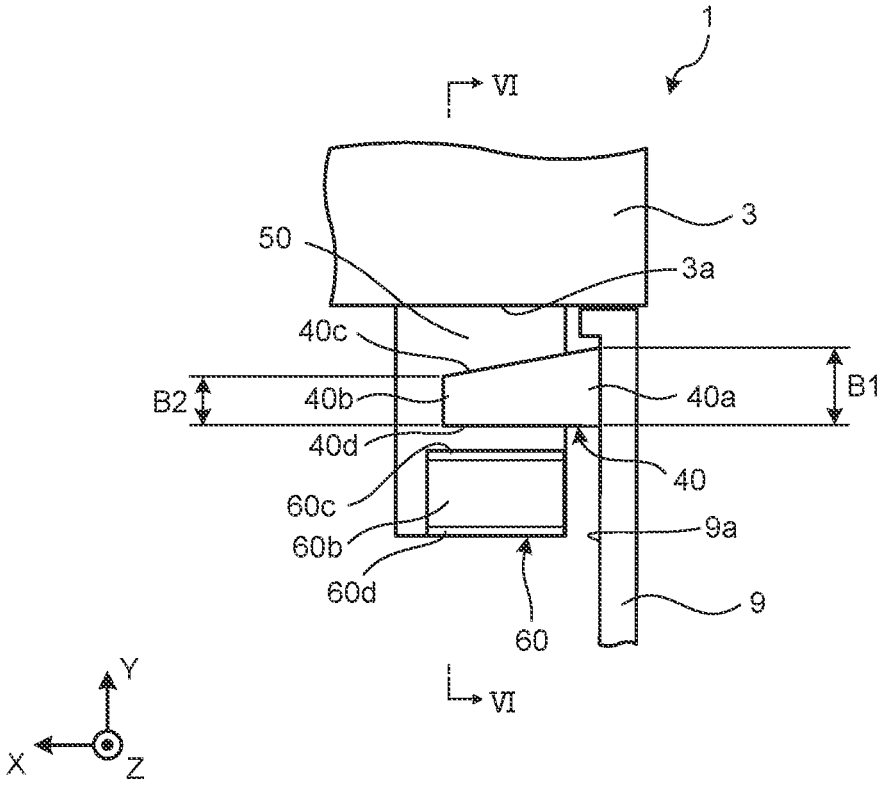
FIG. 5 is an enlarged top view illustrating a periphery of a protruding part of the flush toilet viewed from above.
Figure 6:
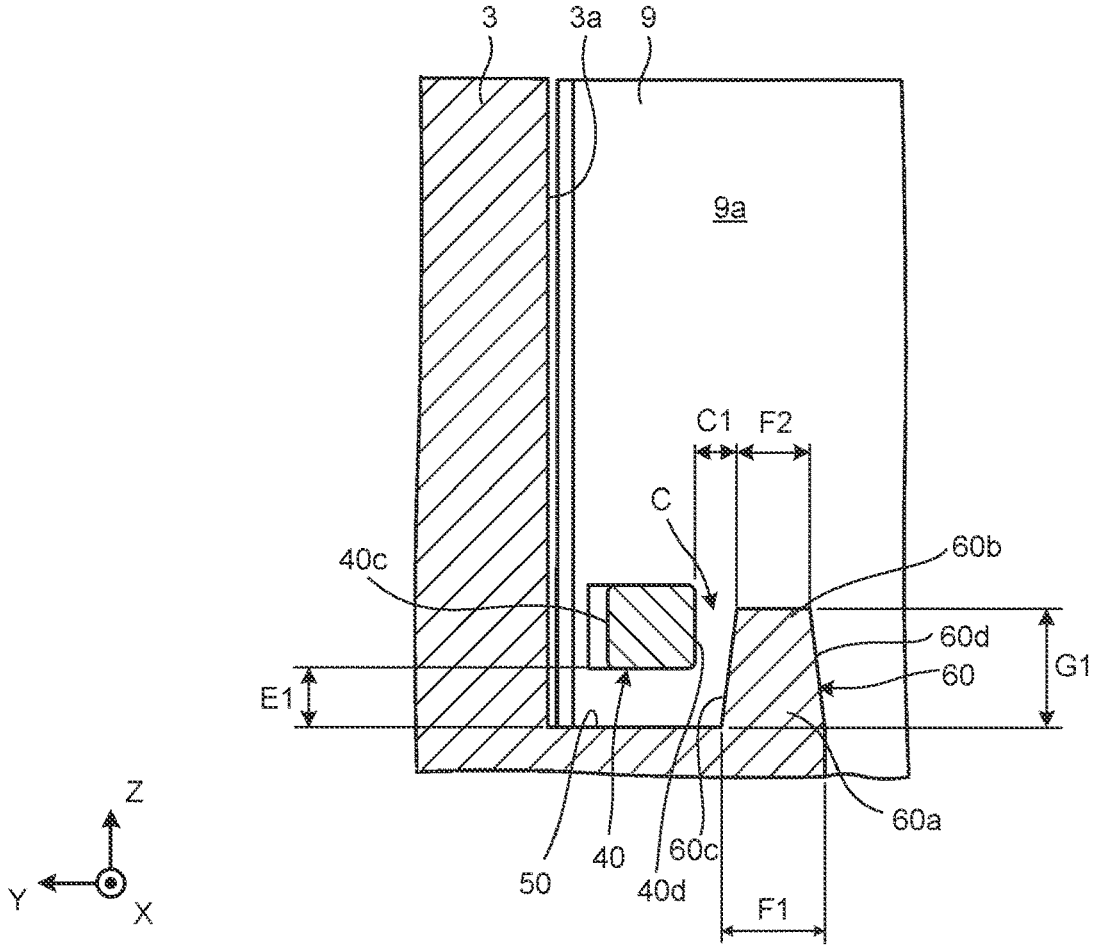
FIG. 6 is a cross-sectional view taken along a line VI-VI illustrated in FIG. 5.
Figure 7:
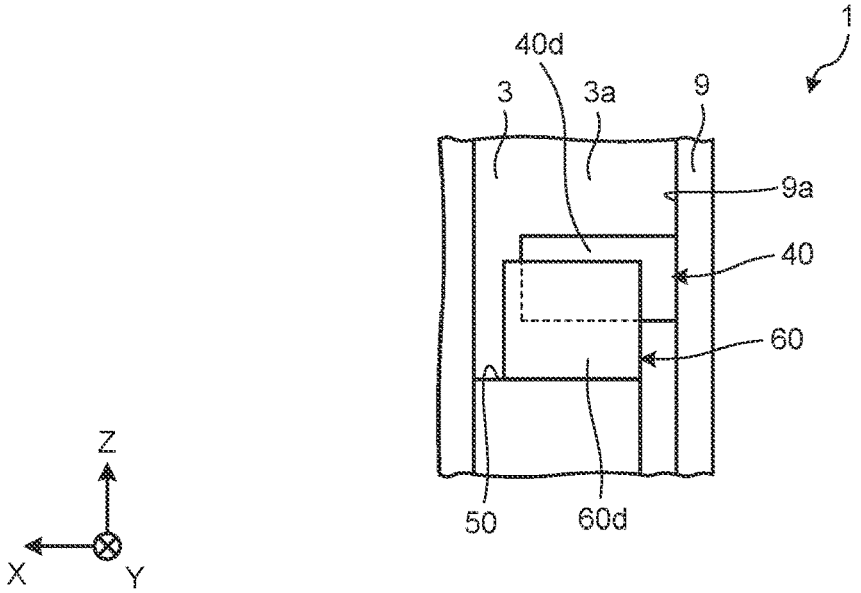
FIG. 7 is an enlarged back view illustrating a periphery of the protruding part of the flush toilet viewed from the behind.

Hereinafter, the protruding part 40 and the like will be explained additionally with reference to FIGS. 5 to 7. FIG. 5 is an enlarged top view illustrating a periphery of the protruding part 40 of the flush toilet 1 viewed from above. FIG. 6 is a cross-sectional view taken along a line VI-VI illustrated in FIG. 5, and FIG. 7 is an enlarged back view (rear view) illustrating a periphery of the protruding part 40 of the flush toilet 1 viewed from the behind.

As illustrated in FIGS. 4 to 7, the protruding part 40 is formed so as to protrude from the panel member 9 toward the toilet body 3. In other words, the protruding part 40 is formed so as to extend from an inner surface 9*a* of the panel member 9 along the left-right direction (X-axis direction) that is an attachment direction to the toilet body 3. Note that a detailed shape of the protruding part 40 will be mentioned later.

In a state where the panel member 9 is attached to the toilet body 3, the reception part 50 is arranged under the protruding part 40 and further is configured to receive the protrusion part 60. For example, the reception part 50 is formed so as to extend from the right rear portion 3*a* of the toilet body 3 toward the rear thereof (Y-axis negative direction), and an upper surface thereof is formed in flat.

The protrusion part 60 is formed so as to extend upward from the reception part 50. For example, in a state where the panel member 9 is attached to the toilet body 3, the protrusion part 60 erects from the reception part 50 so as to position on a side of a back surface 40*d* of the protruding part 40. Note that a detailed shape of the protrusion part 60 will be mentioned later.

As illustrated in FIG. 7, in a state where the panel member 9 is attached to the toilet body 3, the above-mentioned protrusion part 60 is formed in a position where a part thereof is overlapped with the protruding part 40 in a rear view when the toilet body 3 is viewed from the behind. FIG. 7 is a diagram viewed from a side of a back surface 60*d* of the protrusion part 60, and in FIG. 7, a part of the protruding part 40 that is overlapped with the protrusion part 60 is indicated by using a dashed line.

Thus, in the present embodiment, a part of the protrusion part 60 is formed in a position that is overlapped with the protruding part 40 in the rear view, for example, even when wiping down is performed on the panel member 9 and thus load or the like in the front-back direction works on the panel member 9 so as to move the panel member 9 in the front-back direction, the protruding part 40 on a side of the panel member 9 is stopped by the protrusion part 60 on a side of the toilet body 3, so that it is possible to prevent the panel member 9 from falling off from the panel member 9. Falling of the panel member 9 is prevented, and thus damage against the panel member 9 due to falling off and the like can be also prevented.

In the example illustrated in FIG. 7, the protrusion part 60 is formed in a position where a part thereof is overlapped with the protruding part 40 in the rear view; however, not limited thereto, the protrusion part 60 may be formed in a position where whole thereof is overlapped with the protruding part 40. In other words, it is sufficient that the protrusion part 60 is formed in a position where at least a part thereof is overlapped with the protruding part 40 in the rear view.

Next, a detailed shape of the protruding part 40 will be explained. As illustrated in FIG. 5 and the like, the protruding part 40 is formed such that a width in the front-back direction (Y-axis direction) is smaller as a position is closer to a leading end 40*b*. In other words, the protruding part 40 is tapered such that a width in the front-back direction is smaller as a position goes from a base end 40*a* to the leading end 40*b* in a top view. Specifically, the protruding part 40 is formed in a columnar-shaped, for example, a width B2 of the leading end 40*b* in the front-back direction is set to be smaller than a width B1 of the base end 40*a* in the front-back direction (B2<B1).

Therefore, for example, in a case where the panel member 9 is attached to the toilet body 3, the protruding part 40 is easily inserted between the protrusion part 60 and the toilet body 3 (for example, right rear portion 3*a*) at the top of the leading end 40*b* whose width is comparatively small, and thus it is possible to easily attach the panel member 9 to the toilet body 3 and further to easily perform positioning with respect to the toilet body 3.

In a case where the panel member 9 further moves toward the toilet body 3 after the protruding part 40 is inserted between the protrusion part 60 and the toilet body 3, for example, a contractor is going to move the panel member 9 in a state where the panel member 9 is displaced from an appropriate position in some cases. In this case, the protruding part 40 configured as described above is capable of functioning as a guide of the panel member 9 while being in contact with the protrusion part 60 or the toilet body 3 (right rear portion 3*a*), so that it is possible to improve accuracy in positioning of the panel member 9 with respect to the toilet body 3.

As illustrated in FIG. 5 and the like, the protruding part 40 is formed such that the back surface 40*d* is positioned on a side of the protrusion part 60. Furthermore, the protruding part 40 is formed such that a slope of the back surface 40*d* with respect to a perpendicular surface (X-Z plane) in the left-right direction in a top view is smaller than a slope of a front surface 40*c*.

Specifically, in a top view, the front surface 40*c* of the protruding part 40 is a surface that slopes with respect to the perpendicular surface in the left-right direction, and is formed such that the back surface 40*d* is parallel (or substantially parallel) to the perpendicular surface in the left-right direction. In other words, the back surface 40*d* of the protruding part 40 is formed so as to extend along the perpendicular surface in the left-right direction.

Thus, for example, a contact area between the back surface 40*d* of the protruding part 40 and the protrusion part 60 when the panel member 9 moves backward can be increased, so that it is possible to effectively prevent falling off of the panel member 9. In other words, for example, even in a case where wiping down or the like is performed on the panel member 9 so that the panel member 9 moves backward, the protruding part 40 is configured as described above, and thus the back surface 40*d* of the protruding part 40 is capable of easily being in contact with the protrusion part 60, in other words, the protruding part 40 is reliably stopped by the protrusion part 60 to be able to effectively prevent falling off of the panel member 9.

Next, a position in which the protruding part 40 is formed will be explained. As illustrated in FIG. 6, in a state where the panel member 9 is attached to the toilet body 3, the protruding part 40 is positioned so as to form a predetermined gap C from the protrusion part 60. Specifically, the protruding part 40 is positioned such that the predetermined gap C is formed that has a distance C1 in the front-back direction (Y-axis direction) between the back surface 40*d* and a front surface 60*c* of the protrusion part 60. Note that the distance C1 is set to an arbitrary value.

As described above, the predetermined gap C is formed between the protruding part 40 and the protrusion part 60, for example, when positioning is performed while the panel member 9 is being attached to the toilet body 3, a position of the panel member 9 is easily adjusted to an appropriate position. In other words, the predetermined gap C is formed, for example, a contractor can slide the panel member 9 with respect to the toilet body 3 or the like in the front-back direction (see arrow D1 illustrated in FIG. 1) in a state where the panel member 9 is being held to the toilet body 3 or the like, so that it is possible to easily adjust a position of the panel member 9 to an appropriate position.

Herein, a separated distance between the protruding part 40 and the reception part 50 will be explained. In a state where the panel member 9 is attached to the toilet body 3, a distance E1 (see FIG. 6) between the protruding part 40 and the reception part 50 is set to be smaller than a distance E2 (see FIG. 1) between a lower end 9*b* of the panel member 9 and the floor surface 100 on which the toilet body 3 is arranged (E1<E2).

Thus, it is possible to further prevent falling off of the panel member 9. In other words, for example, even in a case where wiping down is performed on the panel member 9 and load or the like works on the panel member 9 in the downward direction (Z-axis the negative direction) and the panel member 9 moves downward, the protruding part 40 is in contact with (is received by) the reception part 50 and is stopped before the lower end 9*b* is in contact with the floor surface 100, and thus it is possible to further reliably prevent falling off of the panel member 9. Moreover, falling off of the panel member 9 is prevented, so that it is further possible to prevent damage against the panel member 9 due to falling off and the like.

Next, a detailed shape of the protrusion part 60 will be explained. As illustrated in FIG. 6 and the like, the protrusion part 60 is formed such that a width thereof in the front-back direction (Y-axis direction) is smaller as a position is closer to a leading end 60*b*. In other words, the protrusion part 60 is tapered such that a width thereof in the front-back direction is narrower as a position goes further from a base end 60*a* toward the leading end 60*b* in a side view. Specifically, the protrusion part 60 is formed in wall-shaped, for example, and a width F2 of the leading end 60*b* in the front-back direction is set to be smaller than a width F1 of a base end 60*a* in the front-back direction (F2<F1).

Thus, for example, in a case where the panel member 9 is attached to the toilet body 3 from the above, the protruding part 40 of the panel member 9 moves downward from a side of the leading end 60*b* of the protrusion part 60 whose width is comparatively small, and thus is easily inserted into between the protrusion part 60 and the toilet body 3 (for example, right rear portion 3*a*), so that it is possible to easily perform positioning of the panel member 9 with respect to the toilet body 3 while facilitating attachment of the panel member 9 to the toilet body 3.

In a case where the panel member 9 further moves downward after the protruding part 40 is inserted into between the protrusion part 60 and the toilet body 3, for example, a contractor moves the panel member 9 in a state where the panel member 9 is displaced from an appropriate position in some cases. In this case, the protrusion part 60 configured as described above is in contact with the protruding part 40 to be able to function as a guide of the panel member 9, so that it is possible to improve the accuracy in positioning of the panel member 9 with respect to the toilet body 3.

Herein, relation between a height G1 (see FIG. 6) from the reception part 50 of the protrusion part 60 and a position (precisely, distance E1 from reception part 50 to protruding part 40) of the protruding part 40 in a case where the panel member 9 is attached will be explained. As described above, in a rear view, the protrusion part 60 is formed in a position where a part thereof is overlapped with the protruding part 40, an overlapped amount G1-E1 between the protrusion part 60 and the protruding part 40 is set to be larger than a distance G2 (see FIG. 1) between an upper end 9*c* of the panel member 9 and a lower end 7*a* of the sanitary washing device 7 in a state where the panel member 9 is attached to the toilet body 3 ("(G1−E1)>G2").

Thus, it is possible to further reliably prevent falling off of the panel member 9. In other words, for example, even in a case where wiping down of the panel member 9 or the like is performed and thus load in the upward direction (Z-axis positive direction) or the like works on the panel member 9, and the panel member 9 moves upward, the upper end 9*c* is in contact with the lower end 7*a* of the sanitary washing device 7 and the panel member 9 is stopped before the protruding part 40 moves beyond a height of the protrusion part 60, so that it is possible to further reliably prevent falling off of the panel member 9. Moreover, falling off of the panel member 9 is prevented, so that it is also possible to prevent damage against the panel member 9 due to falling off.

As described above, the flush toilet 1 according to the embodiment includes the toilet body 3; the function unit 5 that is arranged in a rear part of the toilet body 3; the panel member 9 that covers a side surface of the function unit 5; and the first and second holding parts 21 and 23 that cause the toilet body 3 and the panel member 9 to attract and hold to each other by using magnetic force.

The panel member 9 includes the protruding part 40 that is formed to protrude toward the toilet body 3. The toilet body 3 includes: the reception part 50 that is arranged under the protruding part 40, and receives the protruding part 40 in a state where the panel member 9 is attached to the toilet body 3; and the protrusion part 60 that is formed to extend upward from the reception part 50. The protrusion part 60 is formed in a position where at least a part of the protrusion part 60 is overlapped with the protruding part 40 in a rear view when the toilet body 3 is viewed from behind, in a state where the panel member 9 is attached to the toilet body 3. Thus, it is possible to prevent falling off of the panel member 9 that is attached to the toilet body 3.

Modification

Next, a modification will be explained with reference to FIG. 8. In the following explanation, parts similar to those having been already explained are provided with the same reference symbols as those of the already-explained parts, and duplicated explanation is appropriately omitted.

Figure 8:
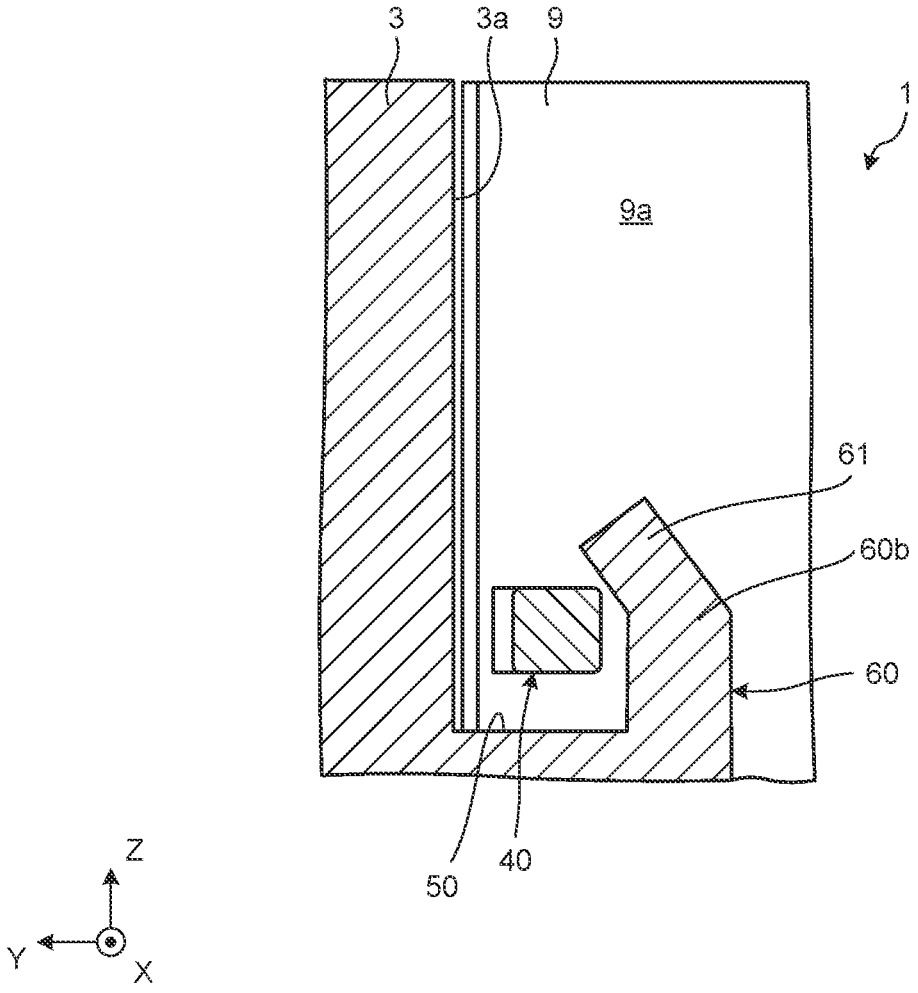
FIG. 8 is a diagram illustrating a flush toilet according to a modification.

FIG. 8 is a diagram illustrating the flush toilet 1 according to the modification. Note that FIG. 8 is a cross-sectional view illustrating peripheries of the protruding part 40 and the protrusion part 60*a*, which are similar to those illustrated in FIG. 6.

As illustrated in FIG. 8, the protrusion part 60 according to the modification includes a bending part 61. In a state where the panel member 9 is attached to the toilet body 3, the bending part 61 bends so as to extend over the protruding part 40. In other words, the bending part 61 is formed so as to extend from the leading end 60*b* of the protrusion part 60 and cover a part above the protruding part 40.

Note that a shape of the bending part 61 illustrated in FIG. 8 is merely one example, and is not limited thereto. In other words, for example, the bending part 61 may have an arbitrary shape as long as at least a part thereof is positioned above the protruding part 40.

Thus, it is possible to further reliably prevent falling off of the panel member 9. In other words, for example, in a case where wiping down or the like is performed on the panel member 9 and load in the upward direction (Z-axis positive direction) or the like works on the panel member 9, the panel member 9 moves upward in some cases. In this case, the protruding part 40 of the panel member 9 is in contact with the bending part 61 so as to prevent an upward movement thereof, so that it is possible to further reliably prevent falling off of the panel member 9. Moreover, if falling off of the panel member 9 is prevented, it is further possible to prevent damage against the panel member 9 due to falling off or the like.

A flush toilet according to one aspect of an embodiment includes: a toilet body; a function unit that is arranged in a rear part of the toilet body; a panel member that covers a side surface of the function unit; and a holding part that causes the toilet body and the panel member to attract and hold to each other by using magnetic force, wherein the panel member includes a protruding part that is formed to protrude toward the toilet body, the toilet body includes: a reception part that is arranged under the protruding part, and receives the protruding part in a state where the panel member is attached to the toilet body; and a protrusion part that is formed to extend upward from the reception part, and in a state where the panel member is attached to the toilet body, the protrusion part is formed in a position where at least a part of the protrusion part is overlapped with the protruding part in a rear view when the toilet body is viewed from behind.

Thus, it is possible to prevent falling off of a panel member from a toilet body. In other words, a protrusion part is formed in a position where at least a part of the protrusion part is overlapped with a protruding part in a rear view, for example, even in a case where wiping down is performed on the panel member, load in the front-back direction or the like works on the panel member so as to move the panel member in the front-back direction, the protruding part on a side of the panel member is stopped by the protrusion part on a side of the toilet body, so that it is possible to prevent falling off of the panel member from the toilet body. Moreover, falling off of the panel member is prevented, so that it is further possible to prevent damage against the panel member due to the falling off.

The protruding part is formed such that a width in the front-back direction is smaller as a position is closer to a leading end.

Therefore, for example, in a case where the panel member is attached to the toilet body, the protruding part is easily inserted between the protrusion part and the toilet body at the top of a leading end whose width is comparatively small, and thus it is possible to easily attach the panel member to the toilet body and further to easily perform positioning with respect to the toilet body.

In a case where the panel member further moves toward the toilet body after the protruding part is inserted between the protrusion part and the toilet body, for example, a contractor is going to move the panel member in a state where the panel member is displaced from an appropriate position, in some cases. In this case, the protruding part configured as described above is capable of functioning as a guide of the panel member while being in contact with the protrusion part or the toilet body, so that it is possible to improve accuracy in positioning of the panel member with respect to the toilet body.

The protruding part is formed such that a back surface is positioned on a side of the protrusion part and a slope of the back surface with respect to a perpendicular surface in a left-right direction in a top view when the toilet body is viewed from above is smaller than a slope of a front surface.

Thus, for example, a contact area between the back surface of the protruding part and the protrusion part when the panel member moves backward can be increased, so that it is possible to effectively prevent falling off of the panel member. In other words, for example, even in a case where wiping down or the like is performed on the panel member so that the panel member moves backward, the protruding part is configured as described above, and thus the back surface of the protruding part is capable of easily being in contact with the protrusion part, in other words, the protruding part is reliably stopped by the protrusion part to be able to effectively prevent falling off of the panel member.

In a state where the panel member is attached to the toilet body, a distance between the protruding part and the reception part is set to be smaller than a distance between a lower end of the panel member and a floor surface on which the toilet body is arranged.

Thus, it is possible to further prevent falling off of the panel member. In other words, for example, even in a case where wiping down is performed on the panel member and load or the like works on the panel member in the downward direction and the panel member moves downward, the protruding part of the panel member is in contact with (is received by) the reception part and is stopped before the lower end is in contact with the floor surface, and thus it is possible to further prevent falling off of the panel member. Moreover, falling off of the panel member is prevented, so that it is further possible to prevent damage against the panel member due to the falling off and the like.

In a state where the panel member is attached to the toilet body, the protruding part is positioned such that a predetermined gap is formed from the protrusion part.

As described above, the predetermined gap is formed between the protruding part and the protrusion part, for example, when positioning is performed while the panel member is being attached to the toilet body, a position of the panel member is easily adjusted to an appropriate position. In other words, the predetermined gap is formed, for example, a contractor can slide the panel member with respect to the toilet body or the like in the front-back direction in a state where the panel member is being held to the toilet body or the like, so that it is possible to easily adjust a position of the panel member to an appropriate position.

The protrusion part is formed such that a width in a front-back direction is smaller as a position is closer to a leading end.

Thus, for example, in a case where the panel member is attached to the toilet body from the above, the protruding part of the panel member moves downward from a side of the leading end of the protrusion part whose width is comparatively small, and thus is easily inserted into between the protrusion part and the toilet body, so that it is possible to easily perform positioning of the panel member with respect to the toilet body while facilitating attachment of the panel member to the toilet body.

In a case where the panel member further moves downward after the protruding part is inserted into between the protrusion part and the toilet body, for example, a contractor moves the panel member in a state where the panel member is displaced from an appropriate position in some cases. In this case, the protrusion part configured as described above is in contact with the protruding part to be able to function as a guide of the panel member, so that it is possible to improve the accuracy in positioning of the panel member with respect to the toilet body.

In a state where the panel member is attached to the toilet body, the protrusion part includes a bending part that bends to extend over the protruding part.

Thus, it is possible to further reliably prevent falling off of the panel member. In other words, for example, in a case where wiping down or the like is performed on the panel member and load in the upward direction or the like works on the panel member, the panel member moves upward in some cases. In this case, the protruding part of the panel member is in contact with the bending part so as to prevent an upward movement thereof, so that it is possible to further reliably prevent falling off of the panel member. Moreover, if falling off of the panel member is prevented, it is further possible to prevent damage against the panel member due to falling off or the like.

In accordance with one aspect of an embodiment, it is possible to prevent falling off of a panel member that is attached to a toilet body.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A flush toilet comprising:

a toilet body;

a function unit arranged in a rear part of the toilet body;

a panel member covering a side surface of the function unit; and a holding part attracting and holding the toilet body and the panel member by using magnetic force thereof, wherein the panel member includes a protruding part protruding toward the toilet body, the toilet body includes:

a reception part arranged under the protruding part and receiving the protruding part when the panel member is attached to the toilet body; and a protrusion part extending upward from the reception part, and when the panel member is attached to the toilet body, at least a part of the protrusion part is overlapped with the protruding part in a rear view of the toilet body.

2. The flush toilet according to claim 1, wherein a width of the protruding part in the front-back direction decreases toward a leading end thereof.

3. The flush toilet according to claim 2, wherein a back surface of the protruding part is positioned on a side of the protrusion part and a slope of the back surface with respect to a perpendicular surface in a left-right direction in a top view of the toilet body is smaller than a slope of a front surface thereof.

4. The flush toilet according to claim 1, wherein when the panel member is attached to the toilet body, a distance between the protruding part and the reception part is smaller than a distance between a lower end of the panel member and a floor surface arranging the toilet body thereon.

5. The flush toilet according to claim 1, wherein when the panel member is attached to the toilet body, a predetermined gap is provided between the protruding part and the protrusion part.

6. The flush toilet according to claim 1, wherein a width of the protrusion part in a front-back direction decreases toward a leading end thereof.

7. The flush toilet according to claim 1, wherein when the panel member is attached to the toilet body, the protrusion part includes a bending part bending to extend over the protruding part.

* * * * *